US006169523B1

(12) United States Patent
Ploussios

(10) Patent No.: US 6,169,523 B1
(45) Date of Patent: Jan. 2, 2001

(54) ELECTRONICALLY TUNED HELIX RADIATOR CHOKE

(76) Inventor: George Ploussios, 60 Central St., Andover, MA (US) 01810

( * ) Notice: Under 35 U.S.C. 154(b), the term of this patent shall be extended for 0 days.

(21) Appl. No.: 09/229,929

(22) Filed: Jan. 13, 1999

(51) Int. Cl.[7] ..... H01Q 1/36
(52) U.S. Cl. ..... 343/895; 343/802
(58) Field of Search ..... 343/745, 749, 343/721, 793, 872, 895, 802

(56) References Cited

U.S. PATENT DOCUMENTS

| | | | | |
|---|---|---|---|---|
| 2,953,786 | * | 9/1960 | Krause | 343/895 |
| 4,008,479 | * | 2/1977 | Smith | 343/895 |
| 4,924,238 | * | 5/1990 | Ploussios | 343/895 |
| 5,406,693 | * | 4/1995 | Egashira et al. | 343/895 |
| 5,612,707 | * | 3/1997 | Vaughan et al. | 343/895 |
| 5,859,621 | * | 1/1999 | Leisten | 343/895 |

* cited by examiner

*Primary Examiner*—Tan Ho
(74) *Attorney, Agent, or Firm*—Devine, Millimet & Branch, P.A.; Paul C. Remus; Kristin Kohler

(57) ABSTRACT

A collinear electronically tunable helical antenna system includes at least one helical antenna coil; a center conductive tube disposed axially through the open center space of the coil, which may contain bias and control lines and feed lines. The antenna coil is short circuited to the center tube near the base of the coil, forming a tunable choke. Sections of the coil are shorted to electrically shorten the coil, thereby tuning the antenna and choke. Each antenna coil is powered via feed lines that emanate from the antenna base and which run through the conductive tube from below the antenna base. Sections of coil may be shorted by a pair of oppositely poled diodes forming a PIN diode switch connected across a section of antenna coil. A bias voltage that controls the switch is supplied to the switch, via bias lines which run within the antenna coil and exit the antenna coil at a point symmetrical between each pair of oppositely poled diodes. The bias voltage is adjusted to permit the PIN diode switch to provide a short circuit across the selected section of coil thus changing the operating frequency of the antenna and choke. No rf current is directly induced in the conductive tube beyond the choke (and open end) of the antenna coil. Additional independently controlled antennas and other devices may therefore be mounted, without mutual interference, along the conductive tube.

14 Claims, 4 Drawing Sheets

ELECTRONICALLY TUNED HELIX RADIATOR CHOKE

FIELD OF THE INVENTION

The invention relates generally to helical antennae used for radiation and reception of electromagnetic energy. More specifically the invention relates to electronically tunable helical antennae, specifically electronically tunable helical antennae with built-in chokes. Specifically, the invention relates to an electronically tunable helical antenna system consisting of a collinear array of independently controlled and fed antennae and fixtures.

BACKGROUND OF THE INVENTION

Modern communications systems deploy a multitude of radios operating independently. Often each radio has a dedicated antenna. In some cases it is desirable to connect two or more antenna elements to one radio. It would be desirable to be able to collinearly mount these independent antennae and their control and feed lines on one support, in a manner that allows their independent operation. In so doing, each of the antennas can be controlled by separate independent radios and/or any two or more antennas may be electrically connected to a single radio. Furthermore, it would be desirable to provide the means to include the electrical control of electrical fixtures mounted on top of the collinear array, such as a warning light.

U.S. Pat. No. 4,924,238 (the '238 patent) to the present inventor discloses an electronically tunable helical antenna that radiates broadside, and that has been demonstrated to operate over very wide frequency bands, i.e. is tunable over as much as a 15:1 frequency band. In the '238 patent, the helical turns of the radiating portion of the antenna are formed of tubular material which may be in the form of a single length of tubing or may comprise a number of parallel coaxial cables with their outer conductors in electrical contact. The antenna is tuned by a series of oppositely poled pairs of diodes that are connected, at spaced points, to the radiating coils of the antenna. When the diodes are biased to be conductive, a section of the radiating helix is short-circuited, reducing the antenna electrical length and increasing its tuned frequency. Bias voltages to control the diodes are provided by leads inside the radiating turns of the helix. Each lead for a pair of diodes emerges at a point electrically balanced between the two spaced points that are connected to the associated diodes. The electrical balance results in no r-f current flows on the bias leads. This type of antenna may be a monopole helical antenna or a dipole antenna with two oppositely disposed arms. The helix diameter typically runs between 0.001 and 0.05 wavelengths. Its length is typically less than 0.05 wavelengths at the lowest operating frequency in the case of the monopole and twice that for the dipole case. The dimension of a typical tunable helical monopole with a minimum operating frequency of 30 MHZ is less than 16 inches in height and less than 4 inches in diameter.

Many existing collinear helical antenna array systems require a large physical space in which to operate, for example, to provide a large enough helix diameter to ensure decoupling of the antenna from a conductive center supporting post, and to provide adequate length for the desired operating wavelength. U.S. Pat. No. 2,293,786 to Krause requires an axial helical physical length preferably in the range between 1.5 and 5 operating wavelengths and a helix diameter and pitch such that the circumference of each turn preferably equals an integral number of operating wavelengths, i.e. diameter>0.3 wavelengths. At an operating frequency of 30 MHZ, this corresponds to a diameter greater than 10 feet and a length of about 48 feet, impractical dimensions in most cases for collinear arraying of elements.

It is known, to form a compact array of independent center-fed collinear dipoles, that feed lines running parallel to the dipole element are required. In order to avoid scatter from these feed lines, which may cause azimuth pattern distortion, it is desirable to run the feed line through the center of the radiating elements. The difficulty is in achieving this without coupling from the dipoles and causing rf currents along the feed lines that limits antenna performance. This is accomplished in the Krause design by proper adjustment of the helix length, helix diameter, and diameter of the centrally located feed line package. The approach allows almost all the energy traveling along the helix length to be radiated from the helical coil before reaching the end of the coil, thereby leaving little to be coupled to the center located feed lines. This is possible because of the greater than 1.5 wavelength long elements used.

It would thus be desirable to be able to array in a collinear fashion the much smaller electronically tunable helix antenna that is a fraction of a wavelength long, that can be tuned and operated over a much wider band than the fixed tuned helical element described by Krause.

SUMMARY OF THE INVENTION

The present invention can provide a compact array of tunable helical antennae, and other devices, having feed and control lines running parallel to the dipole element wherein there is a centrally located conductive tube internal to the array of devices and radiating helices and through which the feed and control lines run, such that multiple antennae and devices may be collinearly mounted along one central conductive tube enabling, for example, multiple antennae with one antenna per radio or multiple antennae per radio.

A first embodiment of the invention, (shown in FIG. 1), includes a collinearly mountable electronically tunable helical monopole antenna system with a helical antenna coil having an open center space, a base, and a centrally located conductive tube disposed axially through the center space of the helical antenna coil and containing feed and control lines for antennae and devices collinearly mounted above the helical monopole. There is an automatic choke means that decouples the centrally located conductive tube from the helical radiator. This is accomplished by shorting the center conductive tube to the helical antenna coil at the base of the helical antenna coil near where the feed is connected to the helical antenna coil. The feed line feeds the antenna beyond where the antenna coil is shorted to the center conductive tube. Both the helical antenna coil and the center conductive tube are connected to a metallic ground plane. The combination of the helix radiator coil and the center conductive tube is effectively a coaxial (coax) transmission line, with the outer conductor/shield being the helix and the center conductive tube being the coax center conductor.

The collinearly mountable antenna system also has at least one selectable means for shorting sections of the helical antenna coil such that the helical antenna coil is electrically shortened by the at least one selectable means for shorting, rendering the helical antenna system tunable by altering the electrical length of the helical antenna. When the helical antenna is operational, it is tuned to be resonant at the desired operating frequency. The tuning is accomplished preferably by appropriately biasing at least one PIN diode switch (which is the preferable selectable means for shorting) located along each helix surface. Resonance occurs when the helix is electrically one quarter (¼) the desired wavelength long, or any odd multiple of ¼ wavelength (such as ¾ wavelength). As the electrical length of the radiator is tuned, the electrical length of the choke, i.e. the coaxial line consisting of the center conductive tube and helical coil is also changed and thereby tunes the automatic choke to the operating frequency of the helical radiator.

A center fed dipole version of the present invention can be implemented by introducing the mirror image of the described helical monopole and center conducting tube. Multiple monopoles, dipoles or combinations of monopoles, dipoles and/or other types of antennae or devices such as lights, may all be mounted along one center conductive tube which houses feed and control lines. All antennae in the array may be housed in a protective structure, casing, or 'radome'. Each radome or similar plastic or fiberglass structure protects the antenna(e) from the elements, and provides support and structure for the antenna system.

There may also be internal support for the system to provide rigidity and to ensure proper spacing of the helix coils, but which is non conductive and has minimal surface to interfere with the function of the antennae. Such internal support may be a non-conductive member of plastic or fiberglass, around which the helical antennae may be wound, and within which the center conductive tube runs.

Accordingly, one aspect of the invention is to provide an electronically tunable helical antenna having a linearly polarized element that generates a broadside beam.

Another aspect of the invention is to provide an electronically tunable helical antenna that is tunable over a wide bandwidth/frequency range.

A further aspect of the invention is to provide a collinearly mountable array of antennae which consists of independent antenna elements that are tunable separately in frequency bands that may or may not overlap and which do not interfere with each other or other antennae or devices in the array.

A still further aspect of the invention is to provide an electronically tunable helical antenna that is insured to be decoupled from the conductive center post that can be used to mount other antennae and devices.

Yet another aspect of the invention is to provide an electronically tunable dipole helical antenna in which the helix may be wound in the same or opposite direction on both arms of the dipole.

Yet a further aspect of the invention is to provide an electronically tunable helical antenna that is conveniently small in dimension—preferably more than 5 times shorter than standard ¼ wavelength monopole and ½ wavelength dipole antennae.

Another aspect of the invention is to provide an electronically tunable helical antenna that is shorted to the center conductive tube to achieve a ¼ wavelength (or odd multiple thereof) transmission line choke between the helix and the center tube.

Still a further aspect of the invention is to provide a compact configuration for multiple antennae wherein several, e.g. 3, independent collinearly mounted electronically tunable helical antennae would be no larger than one standard broadband antenna.

An additional aspect of the invention is to provide a system that eliminates the scattering from antennae in close proximity to each other that can cause radiation pattern nulls in the azimuth plane, by mounting the antennae collinearly rather than adjacent to each other.

Another additional aspect of the invention is to provide a ground plane independent tunable helix dipole.

A still further aspect is to provide an electronically tunable helical system wherein the circumference of the helix is less than 1/30th of a wavelength at the lowest operating frequency.

Another aspect of the invention is to provide a system wherein electronically tunable antennae may be mounted collinearly with not only other antennae, but also with lights, or other equipment, without electrical interference between the various devices.

DETAILED DESCRIPTION OF THE INVENTION

Figure 1:
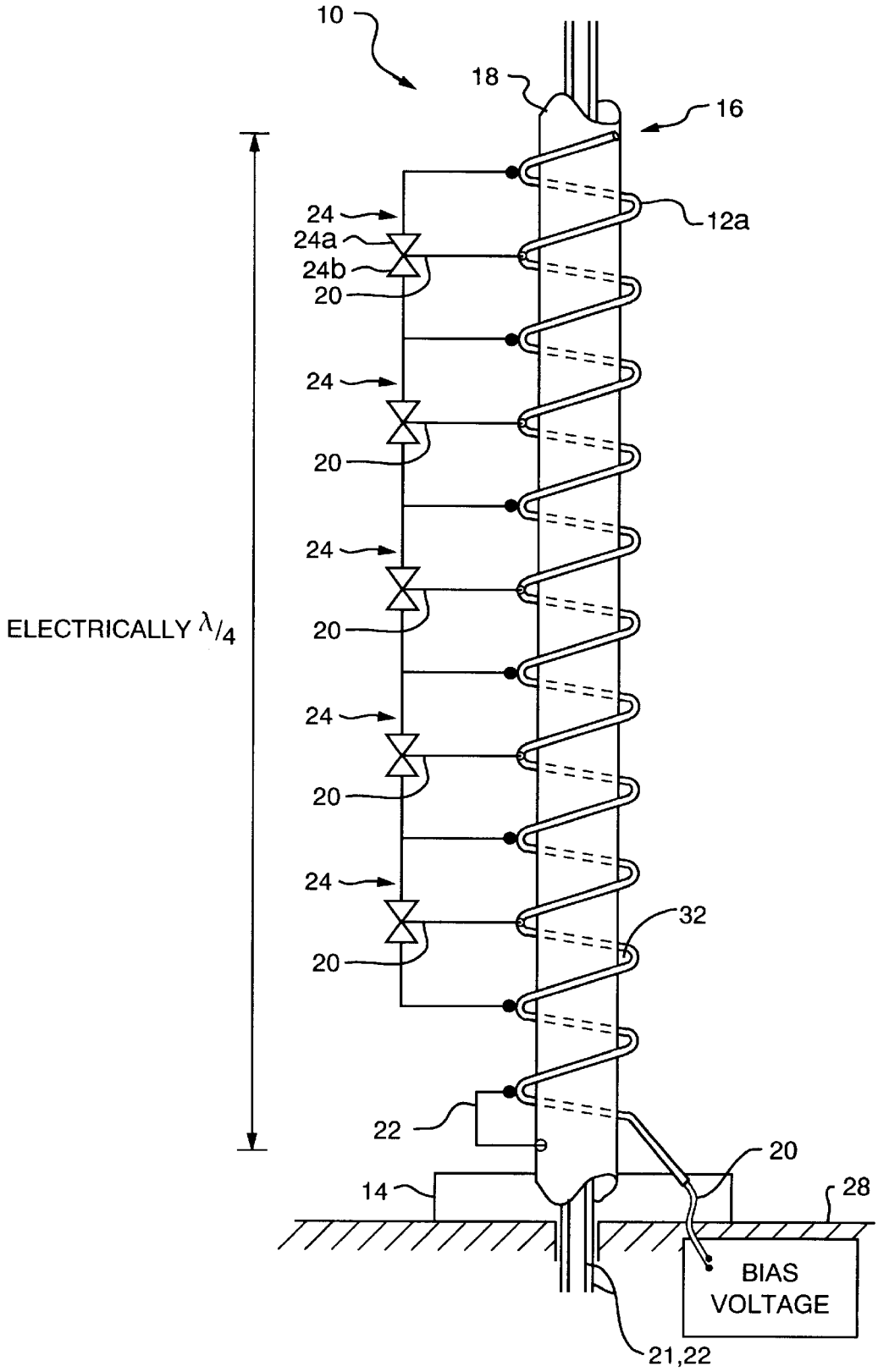
FIG. 1 is a schematic view of an embodiment of the invention using a single monopole antenna.

Referring now to the figures, in which like reference numerals refer to like elements throughout, FIG. 1 shows an embodiment of the collinearly mountable antenna system 10 comprising at least one (shown here with one) hollow helical antenna coil, for example a monopole 12*a,* having an open center space 32, a conducting metallic base 14 and at least one open end 16; a center conductive tube 18 formed of metal and disposed axially through the open center space 32 of helical antenna coil 12*a*. Center conductive tube 18 may contain feed lines 22 and control 21 lines for antennae and other devices that are mounted on tube 18 above the monopole. Any type of feed or control lines may run within center conductive tube 18. However, the feed and control lines do not have to be run within center conductive tube. Center conductive tube 18 simply provides an insulated space within which various power supply and control lines may be run. Center conductive tube 18 is short circuited to helical antenna coil 12*a* at base 14 of helical antenna coil 12*a* to form a transmission line choke. Resonance occurs when the helix is electrically one quarter (¼) the desired wavelength long (or any odd multiple thereof, such as ¾), and the combination of the helical antenna coil and the coaxial center conductive tube, at the open end of the helical antenna coil, behaves like a ¼ wavelength shorted transmission line, i.e. a choke, and therefore presents an infinite impedance between the helix and center conductive tube, such that no significant rf current is directly induced or is present on the center conductive tube, by an active helical antenna coil, above the open end of the helical antenna coil. For ease of explanation, reference for the balance of this description shall be to a ¼ wavelength system. Both helical antenna coil 12*a* and center conductive tube 18 are electrically connected to the base 14 which is in turn connected to a metallic ground plane 28. The antenna system 10 also has at least one selectable means for shorting sections of the helical antenna coil 12*a* such that helical antenna coil 12*a* is electrically shortened by the at least one selectable means for shorting, rendering helical antenna system 10 electronically tunable.

The helical antenna coil system may include a monopole 12*a* as shown in FIG. 1, or a dipole 12*b* as shown in FIG.

Figure 2:
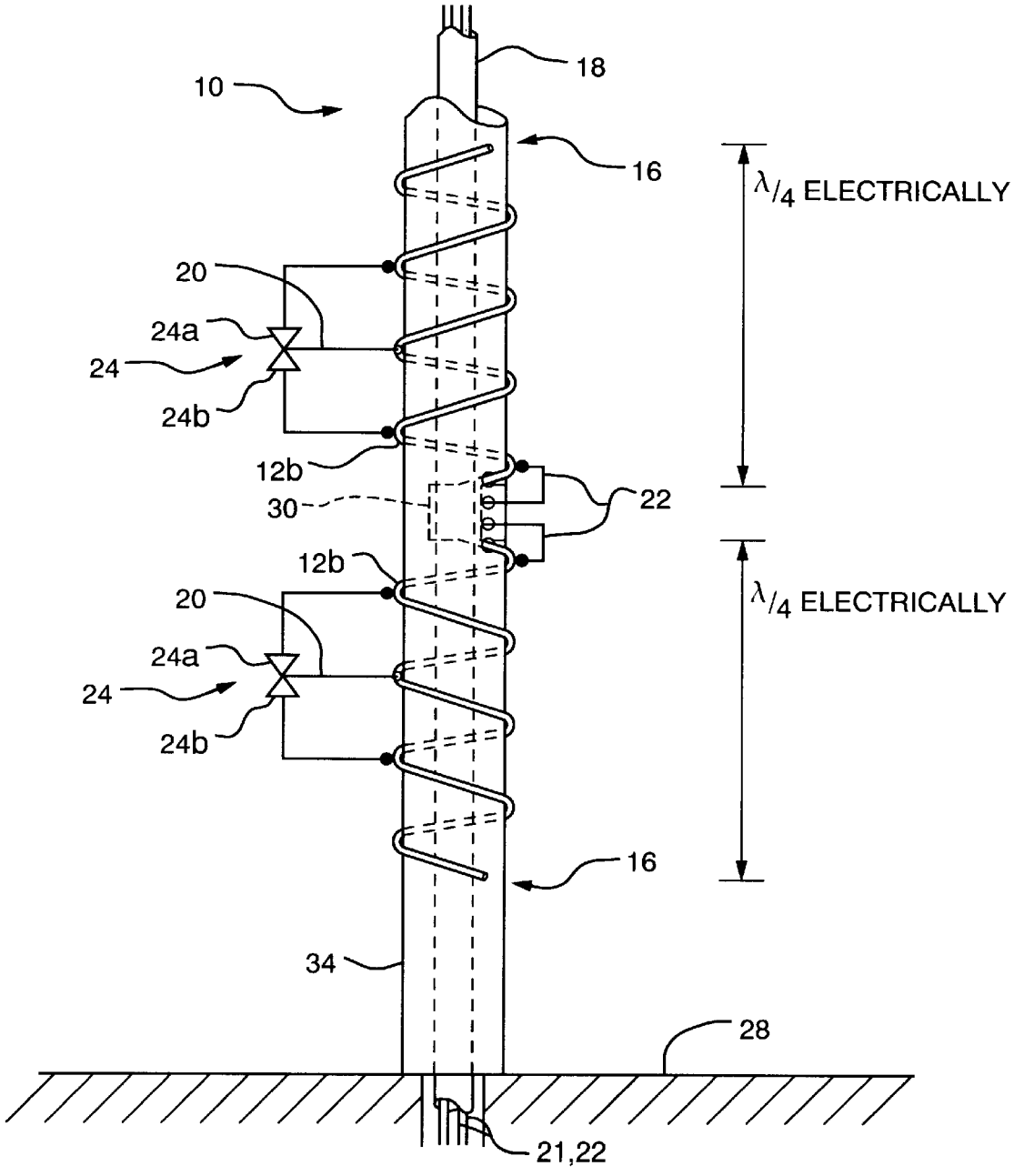
FIG. 2 is a schematic view of an embodiment of the invention using a single dipole antenna.
Figure 3:
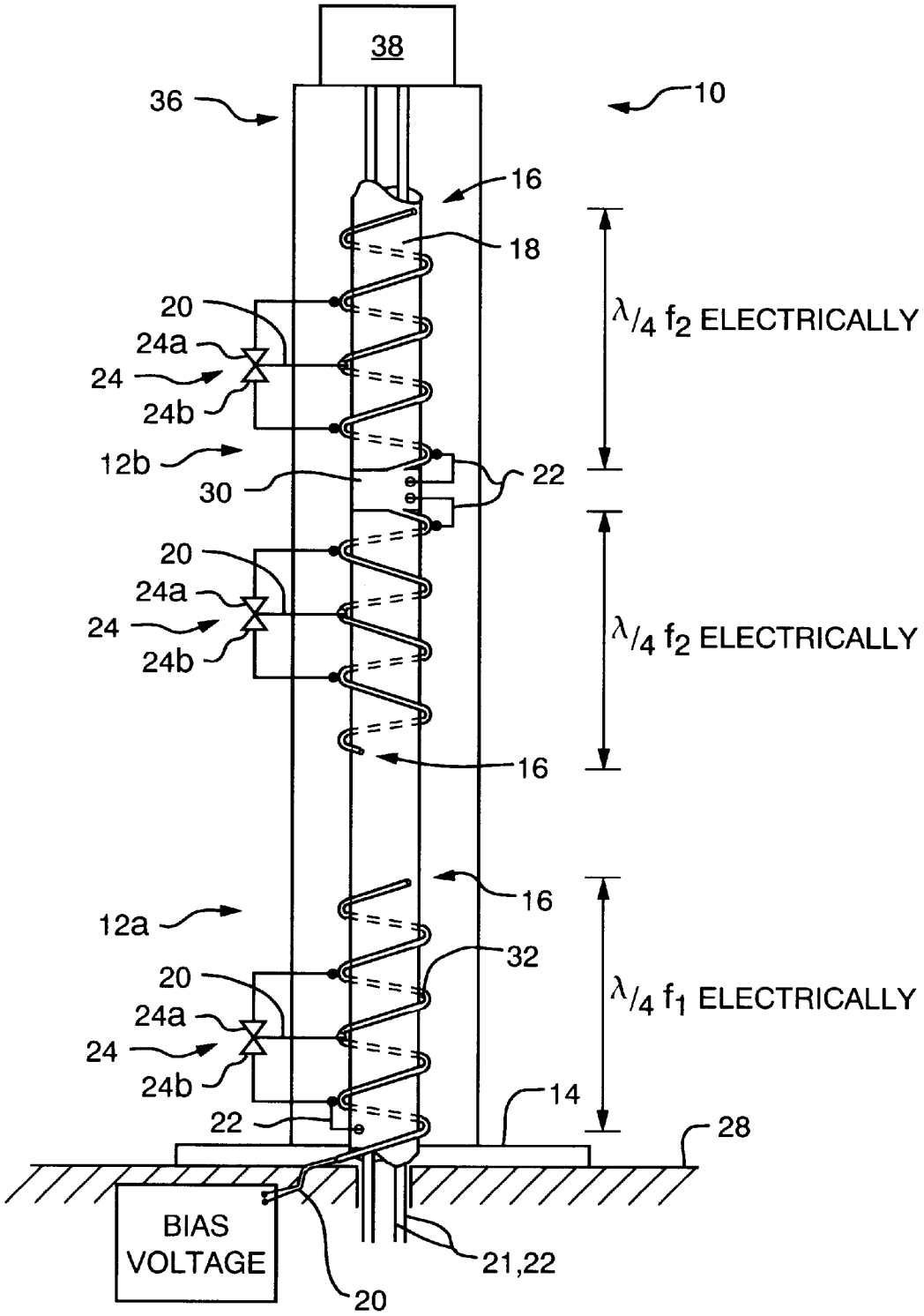
FIG. 3 is a schematic view of an embodiment of the invention showing a stacked mono-pole and dipole mounted along the same central metallic supporting feed tube.

2 or any combination of monopoles, dipoles or other types of antennae as shown in FIG. 3. A dipole configuration is essentially two mirror image monopoles. All control lines 21 and feed lines 22, run through center conductive tube 18 into metal enclosure 30. The control lines 21 may consist of either bias lines for diode switches 24 (24*a* and 24*b*), as shown in FIG. 2, or control lines with signals that instruct control electronics in enclosure 30 to generate the appropriate switch bias levels. All bias lines 20 for the dipole exit the metal enclosure 30 into the hollow winding of dipole 12*b* above and below enclosure 30. The feed line(s) 22 for the dipole would also run through the tube 18 into enclosure 30. The feed line(s) would either be a balanced pair or a coax. If a coax is used, enclosure 30 would include a balun that transforms the unbalanced coax into a balanced 2 wire line needed to feed the dipole. The two wire dipole feed is shown as 22 exiting enclosure 30.

Multiple monopoles, dipoles or combinations of monopoles, dipoles and/or other types of antennae may all be mounted along one center conductive tube with the system of the present invention. Other devices such as for example, lighting devices may also be collinearly mounted on the same center pole. The dipole elements developed for this invention can be used singularly as a stand-alone element, and this design is particularly advantageous when a ground plane-independent element is desired.

The at least one selectable means for shorting section of helical coil is preferably at least one pair of oppositely poled diodes 24*a* and 24*b*, forming a PIN diode switch 24. Each switch 24 is connected across a selected section of helical antenna coil 12*a*, 12*b*. When a bias voltage is supplied by bias lines 20, which extend out from the helical antenna coil 12*a*, 12*b* at a point symmetrical between each pair of oppositely poled diodes, and biased to permit PIN diode switch 24 to conduct in both directions, switch 24 effectively provides a short circuit across the selected section of helical coil thus electrically shortening the helical antenna coil and changing the operating resonant frequency of the electronically tunable helical antenna, thereby tuning the antenna. There are $2^n$ different tunable frequencies for n switches 24.

The minimum physical length of a standard monopole and dipole is typically close to ¼ and ½ wavelength respectively at the operating frequency. The actual physical length of the electrically tunable antennae of the present invention however is considerably shorter than ¼ wavelength. The antenna elements may be shorter than ¼ wavelength by a factor of up to about 10, and thus may actually be as small as one fortieth (1/40) of a wavelength. The physical length of the antenna is determined by its lowest operating frequency. Since the physical length of the antenna is fixed, as the operating frequency is increased, the length, in wavelengths, of the antenna proportionately increases. Whatever the physical length, the electrical length of the helical antenna coil is always an odd multiple of a ¼ wavelength, preferably ¼ wavelength, of the desired operating frequency of the antenna system.

Figure 4:
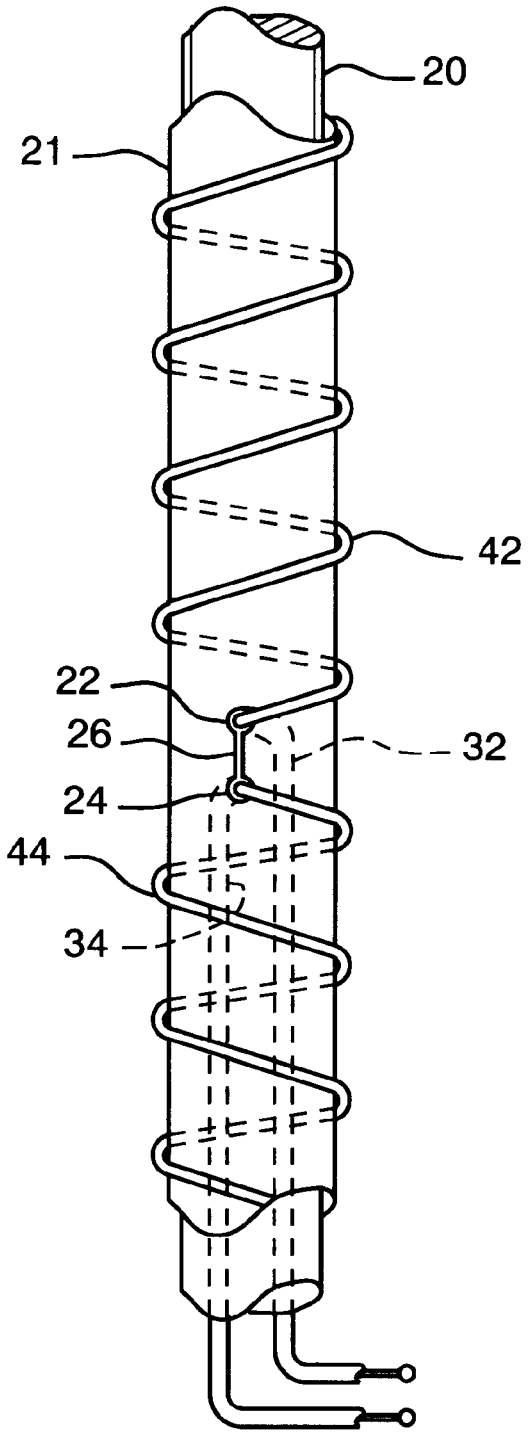
FIG. 4 (PRIOR ART)
FIG. 4 shows prior art for a helical broadside radiating element mounted on a metallic tube.

The diameter of the coil of the antenna of the present invention is typically less than ⅕ times its length and governed by mechanical as well as electrical considerations. The tunable helical antennae of the present invention, with a minimum operating frequency of 30 MHZ would have a diameter that is less than 4 inches and a circumference that is less than 1/30 wavelength. Prior art collinearly mounted helical antennae, such as that shown in FIG. 4, require helix elements at least 30 times larger than those of the present invention. For example, the helical circumference of the prior art Krause elements of FIG. 4 must be some integral number of wavelengths, such as 1 or 2 wavelengths, whereas, noted above, the circumference of helical elements of the present invention may be 1/30th of a wavelength.

In addition to tunable antennae of the present invention, fixed tuning antennae and other types of devices, such as lighting fixtures, may also be mounted collinearly along conductive tube 18 in various combinations.

The system also comprises an automatic choke mechanism in which helical antenna coil 12*a*, 12*b* is shorted, to the center conductive tube 18 near the base 14 of the helical antenna coil for a monopole, or near the base of each half of the dipole, enclosure 30. The center conductive tube 18 is internal to the helical coils 12*a*, 12*b* and the coils 12*a*, 12*b* form, at the operating frequency, a tunable ¼ wavelength coaxial line that is shorted at the base (for coil 12*a*) or enclosure 30 (for coil 12*b*). When the operating frequency is changed the electrical length of the radiating helical coils 12*a*, 12*b*, as well as the electrical length of the coaxial lines is changed to a new length corresponding to ¼ wavelength at the new frequency. At the open end 16 of the helical antenna coil, the helical antenna coil (12*a*, 12*b*) and the internal coaxial center conductive tube 18, electrically appear as an internal, or built-in choke, i.e. an open circuit at the resonant frequency of the helical antenna coil. Thus the choke mechanism is internal to the system and automatically tunes to the operating frequency. The automatic choke assures that no significant rf current is directly induced on center conductive tube 18 beyond open end 16 of the helix, where it would interfere with additional antennae or other devices causing pattern distortion and tuning errors. The center conductive tube is effectively decoupled from the helical radiator.

As shown, in FIG. 3, the invention enables a compact array of a variety of monopoles 12*a*, dipoles 12*b* and other antennae or devices, such as lighting, to be collinearly mounted. Since center conductive tube 18 is decoupled from the helical radiators, the only coupling between antennae is through space. In FIG. 3, there is a helical monopole antenna 12*a* tunable to frequency range f1, and a collinearly mounted center-fed helical dipole antenna 12*b* tunable to a second frequency range f2. Frequency ranges f1 and f2 may, or may not, overlap. If the frequencies do not overlap, the spacing between the ends of the antennae could be as small as the length of the monopole. If the frequencies do overlap, the spacing between antenna ends would have to increase to about ⅛ wavelengths in order to operate independently without interference. As an example, a collinear tunable helical array of two dipoles and one monopole covering the 30 to 90 MHZ band would be about 9 feet long if the elements did not simultaneously operate at the same frequency or about 14.5 feet long if they did operate independently at the same frequency. A broad band antenna covering the same frequency band is typically at least 10 feet long. When multiple radios are used with a single broad band antenna, they operate through a multiplexer that requires non-overlapping frequencies in order to operate satisfactorily. Therefore, the 9 foot collinear helical array without a multiplexer compares with a the 10 foot broad band antenna with a multiplexer from an operations standpoint.

When mounted in an array, if there is a monopole antenna it should be at the base of the array such that it is connectable to a ground plane.

The electronically tunable helical antennae of the present invention may be mounted, as shown in FIGS. 1 and 3, around a conductive center tube that houses feed lines 22, and control lines 21, or may be mounted directly on a non-conductive tube such as a plastic or fiberglass tube 34 that has a conductive tube 18 running therethrough, as shown in FIG. 2. The plastic or fiberglass tube 34 provides rigidity and structural support and helps ensure the proper spacing of the coils of the helix. There may also be other internal or external supports for the helical antennae, as are known in the Art. For example, the internal support may also be an "X" or cross-shaped structure disposed within the center open center space, and around which the helical antennae are wound. The entire assembly may be enclosed in a protective radome 36 covering of plastic or fiberglass, to add structure and to protect the enclosed antennae from the elements. Additionally, the helical elements, although shown in the Figures as circular or round helices, may be elliptical, or any shape that may be wound. Antennae that may be mounted collinearly in the system of the present invention may be helical, or non-helical, tunable or non-tunable, and the system may also accommodate lighting 38 or other devices that may be supported in a collinear array with the antennae.

Although the present invention has been described in a non-limiting manner with the above-identified preferred embodiments, those persons skilled in the art will recognize that changes may be made in form and detail of structure and operation without departing from the spirit and scope of the invention.

Accordingly, what is claimed is:

1. A collinearly mountable antenna system comprising:

at least one electronically tunable helical antenna coil having an open center space, a base and at least one open end;

a center conductive tube disposed axially through said open center space, physically separated from each said antenna coil, and extending at least to said at least one open end;

feed and control lines for each said antenna coil;

an automatic choke such that no rf current is generated on said center conductive tube beyond said at least one open end of each said antenna coil; and a means for tuning each said antenna coil to an operating frequency.

2. The collinearly mountable antenna system of claim 1 wherein said feed lines run within said center conductive tube.

3. The collinearly mountable antenna system of claim 1 wherein said control lines run within said center conductive tube.

4. The collinearly mountable antenna system of claim 1 wherein said means for tuning comprises at least one selectable means for shorting sections of each said antenna coil, such that the electrical length of each said antenna coil is shortened, thereby tuning each said antenna coil, and said automatic choke, to represent a quarter-wavelength resonant structure at a given operating frequency.

5. The collinearly mountable antenna system of claim 4 wherein said at least one selectable means for shorting comprises at least one pair of oppositely poled diodes forming a PIN diode switch, wherein each said PIN diode switch is connected across a selected section of each said antenna coil such that when a bias voltage is adjusted to permit each said PIN diode switch to conduct in both directions, each said PIN diode switch provides a short circuit across each said section of antenna coil, thus electrically shortening said antenna coil, changing the operating resonant frequency of said antenna coil, and thereby tuning said antenna coil.

6. The collinearly mountable antenna system of claim 5 wherein said bias voltage is supplied by bias lines run within each said antenna coil.

7. The collinearly mountable antenna system of claim 1 wherein said automatic choke comprises each said antenna coil and said center conductive tube wherein a short circuit of each said antenna coil to said center conductive tube near said base of each said antenna coil, assures that no current is present in said center conductive tube beyond said at least one open end of each said antenna coil thereby forming said automatic choke.

8. The collinearly mountable antenna system of claim 1 wherein each said antenna coil is a monopole.

9. The collinearly mountable antenna system of claim 1 wherein said center conductive tube extends beyond said at least one open end of each said antenna coil such that other devices are collinearly mountable along said center conductive tube.

10. The collinearly mountable antenna system of claim 9 wherein feed lines for said other devices run within said center conductive tube.

11. The collinearly mountable antenna system of claim 10 wherein said other devices include antennae and lighting devices.

12. The collinearly mountable antenna system of claim 1 wherein there is a hollow non-conductive support member disposed co-axially with said center conductive tube, through which said center conductive tube is disposed, and around which each said antenna coil is wound to support each said antenna coil and to maintain proper spacing of the coils of each said antenna coil.

13. The collinearly mountable antenna system of claim 1 wherein said system is enclosable in a protective radome.

14. The collinearly mountable antenna system of claim 1 wherein each said antenna coil is a dipole.

* * * * *